US007730562B2

(12) United States Patent
Hornbach et al.

(10) Patent No.: US 7,730,562 B2
(45) Date of Patent: Jun. 8, 2010

(54) PATIENT SUPPORT HAVING POWERED ADJUSTABLE WIDTH

(75) Inventors: David W. Hornbach, Brookville, IN (US); Gregory W. Branson, Batesville, IN (US)

(73) Assignee: Hill-Rom Services, Inc., Wilmington, DE (US)

( * ) Notice: Subject to any disclaimer, the term of this patent is extended or adjusted under 35 U.S.C. 154(b) by 9 days.

(21) Appl. No.: 12/184,661

(22) Filed: Aug. 1, 2008

(65) Prior Publication Data

US 2008/0282472 A1 Nov. 20, 2008

Related U.S. Application Data

(63) Continuation of application No. 11/192,887, filed on Jul. 29, 2005, now Pat. No. 7,406,729.

(60) Provisional application No. 60/592,642, filed on Jul. 30, 2004.

(51) Int. Cl.
*A61G 7/002* (2006.01)

(52) U.S. Cl. ..... 5/613; 5/600; 5/185

(58) Field of Classification Search ..... 5/613, 5/600, 616–618, 624, 185; 340/825.19
See application file for complete search history.

(56) References Cited

U.S. PATENT DOCUMENTS

| | | | | |
|---|---|---|---|---|
| 3,220,021 | A | 11/1965 | Nelson | |
| 3,220,022 | A | 11/1965 | Nelson | |
| 3,413,663 | A | 12/1968 | Swann | |
| 3,893,197 | A | 7/1975 | Ricke | |
| 4,183,015 | A * | 1/1980 | Drew et al. | 340/825.19 |
| 4,409,695 | A | 10/1983 | Johnston et al. | |
| 4,669,136 | A | 6/1987 | Waters et al. | |
| 4,680,790 | A * | 7/1987 | Packard et al. | 379/432 |
| 4,700,417 | A | 10/1987 | McGovern | |
| 4,803,744 | A * | 2/1989 | Peck et al. | 5/713 |
| 4,805,249 | A | 2/1989 | Usman et al. | |
| 4,847,929 | A | 7/1989 | Pupovic | |
| 4,985,946 | A | 1/1991 | Foster et al. | |
| 5,023,967 | A | 6/1991 | Ferrand | |

(Continued)

FOREIGN PATENT DOCUMENTS

EP 1 020 146 7/2000

(Continued)

OTHER PUBLICATIONS

Healthcare Ergonomics—Improving Caregiver Safety and Efficiency, Hill-Rom A Hillenbrand Industries, 2001.

(Continued)

*Primary Examiner*—Robert G Santos
(74) *Attorney, Agent, or Firm*—Barnes & Thornburg LLP

(57) ABSTRACT

A patient support for supporting a patient is provided. The patient support includes a frame and a deck. The deck includes first and second ends and longitudinal sides extending therebetween. The deck also includes a first portion and a second portion that is configured to extend laterally from the deck to widen the deck. An actuator is coupled to the deck and configured to move the second portion relative to the first portion between an extended position and a retracted position.

20 Claims, 15 Drawing Sheets

U.S. PATENT DOCUMENTS

| | | | | |
|---|---|---|---|---|
| 5,077,843 | A | 1/1992 | Dale et al. | |
| 5,083,332 | A | 1/1992 | Foster et al. | |
| 5,179,744 | A | 1/1993 | Foster et al. | |
| 5,345,629 | A | 9/1994 | Ferrand | |
| 5,377,370 | A | 1/1995 | Foster et al. | |
| 5,479,666 | A | 1/1996 | Foster et al. | |
| 5,542,136 | A * | 8/1996 | Tappel | 5/710 |
| 5,542,138 | A | 8/1996 | Williams et al. | |
| 5,592,153 | A | 1/1997 | Welling et al. | |
| 5,628,078 | A | 5/1997 | Pennington et al. | |
| 5,630,238 | A | 5/1997 | Weismiller et al. | |
| 5,745,936 | A | 5/1998 | Van McCutchen et al. | |
| 5,771,511 | A | 6/1998 | Kummer et al. | |
| 5,878,452 | A * | 3/1999 | Brooke et al. | 5/428 |
| 6,008,598 | A | 12/1999 | Luff et al. | |
| 6,131,868 | A | 10/2000 | Welling et al. | |
| 6,182,310 | B1 | 2/2001 | Weismiller et al. | |
| 6,185,767 | B1 | 2/2001 | Brooke et al. | |
| 6,226,816 | B1 | 5/2001 | Webster et al. | |
| 6,279,183 | B1 | 8/2001 | Kummer et al. | |
| 6,320,510 | B2 | 11/2001 | Menkedick et al. | |
| 6,324,709 | B1 | 12/2001 | Ikeda et al. | |
| 6,357,065 | B1 | 3/2002 | Adams | |
| 6,362,725 | B1 | 3/2002 | Ulrich et al. | |
| 6,396,224 | B1 | 5/2002 | Luff et al. | |
| 6,486,792 | B1 | 11/2002 | Moster et al. | |
| 6,526,609 | B2 | 3/2003 | Wong | |
| 6,658,680 | B2 | 12/2003 | Osborne et al. | |
| 6,675,415 | B2 | 1/2004 | Wong | |
| 6,678,908 | B2 | 1/2004 | Borders et al. | |
| 6,880,189 | B2 | 4/2005 | Welling et al. | |
| 7,210,180 | B2 | 5/2007 | Malcolm | |
| 7,363,663 | B2 * | 4/2008 | Chambers et al. | 5/185 |
| 7,406,729 | B2 * | 8/2008 | Hornbach et al. | 5/613 |
| 7,461,425 | B2 * | 12/2008 | Chambers et al. | 5/690 |
| 7,464,425 | B2 * | 12/2008 | Chambers et al. | 5/739 |
| 7,568,247 | B2 * | 8/2009 | Strobel et al. | 5/613 |
| 2001/0044971 | A1 | 11/2001 | Borders et al. | |
| 2005/0081295 | A1 | 4/2005 | Malcolm | |
| 2006/0021142 | A1 * | 2/2006 | Hornbach et al. | 5/600 |
| 2006/0026762 | A1 | 2/2006 | Hornbach et al. | |
| 2006/0195984 | A1 * | 9/2006 | Hakamiun et al. | 5/430 |
| 2008/0040857 | A1 | 2/2008 | Karmer et al. | |
| 2008/0282472 | A1 * | 11/2008 | Hornbach et al. | 5/616 |

FOREIGN PATENT DOCUMENTS

| | | |
|---|---|---|
| EP | 1 296 580 | 4/2003 |
| GB | 2313303 | 11/1997 |
| WO | WO 99/15126 | 4/1999 |

OTHER PUBLICATIONS

Magnum II—Bariatric Patient Care System, Hill-Rom A Hillenbrand Industries, 1997.

Magnum II—Bariatric Patient Care System, Hill-Rom A Hillenbrand Industries, 2001.

* cited by examiner

PATIENT SUPPORT HAVING POWERED ADJUSTABLE WIDTH

This application is a continuation of U.S. patent application Ser. No. 11/192,887, filed Jul. 29, 2005, issued as U.S. Pat. No. 7,406,729 on Aug. 5, 2008, which claimed the benefit of U.S. Provisional Patent Application No. 60/592,642 filed Jul. 30, 2004, each of which is hereby incorporated by reference herein.

This application is related to U.S. patent application Ser. No. 10/107,777, published as U.S. 2002/0174487, filed Mar. 27, 2002; U.S. Provisional Patent Application No. 60/591,838, entitled HOSPITAL BED filed Jul. 28, 2004 and corresponding U.S. patent application Ser. No. 11/191,651, filed Jul. 28, 2005; U.S. Provisional Patent Application No. 60/592,775, entitled PATIENT SUPPORT HAVING AN ADJUSTABLE POPLITEAL LENGTH filed Jul. 30,2004 and corresponding U.S. patent application Ser. No. 11/194,347 filed Jul. 29, 2005; and U.S. Provisional Patent Application No. 60/592,613, entitled ADVANCED ARTICULATION SYSTEM AND MATTRESS SUPPORT FOR A BED filed Jul. 30, 2004 and corresponding U.S. patent application Ser. No. 11/192,698, filed Jul. 29, 2005, and U.S. Provisional Patent Application No. 60/592,540, entitled BED HAVING A CHAIR EGRESS POSITION filed Jul. 30, 2004 and corresponding U.S. patent application Ser. No. 11/192,897 filed Jul. 29, 2005, all of which are expressly incorporated herein by reference.

BACKGROUND AND SUMMARY

In the current healthcare environment, hospitals and patient care facilities are treating an ever increasing number of large patients, particularly bariatric patients. Larger patients may not be comfortable on a standard hospital bed having a standard width. Hospital beds having wider decks and corresponding wider mattresses may provide larger patients more comfort, but may be difficult to maneuver down hallways, through doorways, etc. due to the increased width. Also, current expandable width mattresses may become uneven when in the narrowest position and produce uneven raised portions which apply more pressure to a particular section of a patient than to other sections of the patient.

A patient support is provided. The patient support includes a frame, a deck supported by the frame, the deck being configureable to support a patient in a horizontal position, the deck including first and second ends and longitudinal sides extending therebetween, the deck including a first portion configured to extend laterally from the deck to widen the deck; and an actuator coupled to the deck and configured to move the first portion between an extended position and a retracted position. The deck may include a plurality of deck sections. The plurality of deck sections may include a head section, a back section, and a seat section. The head section, the back section, and the seat section may each include a portion configured to extend laterally.

The first portion may extend laterally in a first direction and the deck may include a second portion configured to extend laterally an opposing direction. The first portion may extend along one of the longitudinal sides of the deck and the second portion extends along the opposing longitudinal side of the deck.

The patient support may further include a siderail positioned adjacent the longitudinal side of the deck, the siderail being configured to extend laterally from the deck when the first portion extends to widen the deck. The actuator may be a hydraulic cylinder.

The patient support may further include a telescopic support coupled the first portion and configured to support the first portion in the laterally extended position. The patient support may further include a siderail coupled to the telescopic support. The patient support may further include a controller configured to actuate the actuator to extend or retract the first portion.

In another embodiment, a patient support is provided. The patient support includes a frame and a deck supported by the frame, the deck being configurable to support a patient in a horizontal position, the deck including a plurality of deck sections including an extendable foot section, at least one of the deck sections including first and second portions, the second portion moveable between one of a laterally extended position and a laterally retracted position relative to the first portion.

The patient support may further include an actuator configured to move the extendable foot section between a retracted position and an extended position. The patient support may further include an actuator configured to laterally extend and retract the second portion. The deck may include a head section, a back section, a seat section, and a thigh section. The head section, the back section, and the thigh section may each include first and second portions, the second portion moveable between a laterally extended position and a laterally retracted position. The mattress may include a plurality of vertical openings configured to allow the mattress to compress when the extendable foot section is moved between an extended position and a retracted position.

In yet another embodiment, a patient support is provided, including a frame, a deck supported by the frame, the deck including first and second ends and longitudinal sides extending therebetween, the deck including a first portion configured to laterally extend and retract from the deck to widen and narrow the deck, and a first siderail supported by the frame, the first siderail being positioned adjacent to the first portion and configured to laterally extend and retract with the first portion.

The first siderail may be rigidly coupled to the first portion. The first siderail may be moveable between a raised position and a lowered position. The first siderail may be moveable between the raised and lowered positions when the first portion is in one of the laterally extended and retracted positions.

The patient support may further include a second siderail positioned adjacent to the first siderail, the second siderail including a curved end portion corresponding to a relieved portion of the first siderail.

In still another embodiment, a patient support is provided, including a frame,a deck including a head end, a foot end, and longitudinal sides extending therebetween, a first siderail supported by the frame and positioned adjacent the deck; and an actuator coupled to the siderail and configured to move the siderail between a retracted position and a laterally extended position. The first siderail may be supported by a moveable deck section configured to widen the deck. The first siderail may be moveable between a raised position and a lowered position.

The deck may include at least a head section, a seat section, and a foot section, the first siderail coupled to the head section and a second siderail coupled to the seat section, the second siderail positioned adjacent the first siderail.

In yet another embodiment, a patient support is provided, including a frame, a deck including a head end, a foot end, and longitudinal sides extending therebetween, a siderail positioned adjacent the deck, the siderail being moveable between a retracted position and a laterally extended position, the siderail being lockable in one of the laterally extended position and the retracted position.

The siderail may be moved between the retracted position and the laterally extended position by a hydraulic cylinder. The siderail may be moveable between a raised position and a lowered position. The deck may include a first portion configured to extend from the deck to widen the deck.

The patient support may also include a plurality of siderails moveable between the retracted position and the laterally extended position, at least two of the plurality of siderails being lockable in one of the laterally extended position and the retracted position.

In still another embodiment, a patient support is provided, including a frame, a deck supported by the frame, the deck including first and second ends and longitudinal sides extending therebetween, the deck including a first portion configured to extend and retract laterally from the deck to widen and narrow the deck, a mattress supported by the deck; and a mattress support member positioned adjacent the mattress and configured to laterally compress the mattress when the first portion is retracted. The mattress support member may be supported by the first portion. The mattress support member may include first and second ends coupled to the first portion and a second portion extending between the first and second ends. The deck may include a second portion opposing the first portion and configured to laterally extend and retract to widen or narrow the deck, the first portion supporting a first mattress support member and the second portion supporting a second mattress support member.

The mattress support member may be positioned adjacent a siderail supported by the first portion. The siderail may be positioned adjacent to the first portion and configured to laterally extend and retract with the first portion. The siderail may be movable between a raised position and a lowered position when the first portion is extended or retracted.

The mattress may include a plurality of spaced-apart substantially diamond-shaped cut-out regions configured to allow the mattress to compress. Each of the cut-out regions may include at least one notched portion that has a profile that is one of rectangular and circular in shape.

In yet another embodiment, a patient support is provided, including a frame, a deck including a head end, a foot end, and a pair of longitudinal sides extending therebetween, the longitudinal sides defining a longitudinal axis; and a siderail supported by the frame and positioned at a first longitudinal position relative to the deck, the siderail being moveable between a raised orientation and a lowered orientation, the siderail being moveable between a retracted position and a laterally extended position in both the raised and lowered orientations, the siderail further configured to maintain the first longitudinal position in the raised orientation during movement between the retracted position and the laterally extended position. The siderail may be configured to maintain the first longitudinal position in the lowered orientation.

In still another embodiment, a patient support is provided, including a frame, a deck including a head end, a foot end, and a pair of longitudinal sides extending therebetween, the longitudinal sides defining lateral edges of the deck, the deck including a first portion moveable between a retracted position and a laterally extended position to widen and narrow the deck; and a siderail supported by the frame and spaced apart from the lateral edge of the deck by a first distance, the first distance remaining constant as the first portion is moved between the retracted position and the laterally extended position. The siderail may be moveable between a raised position and a lowered position.

DETAILED DESCRIPTION

Figure 1:
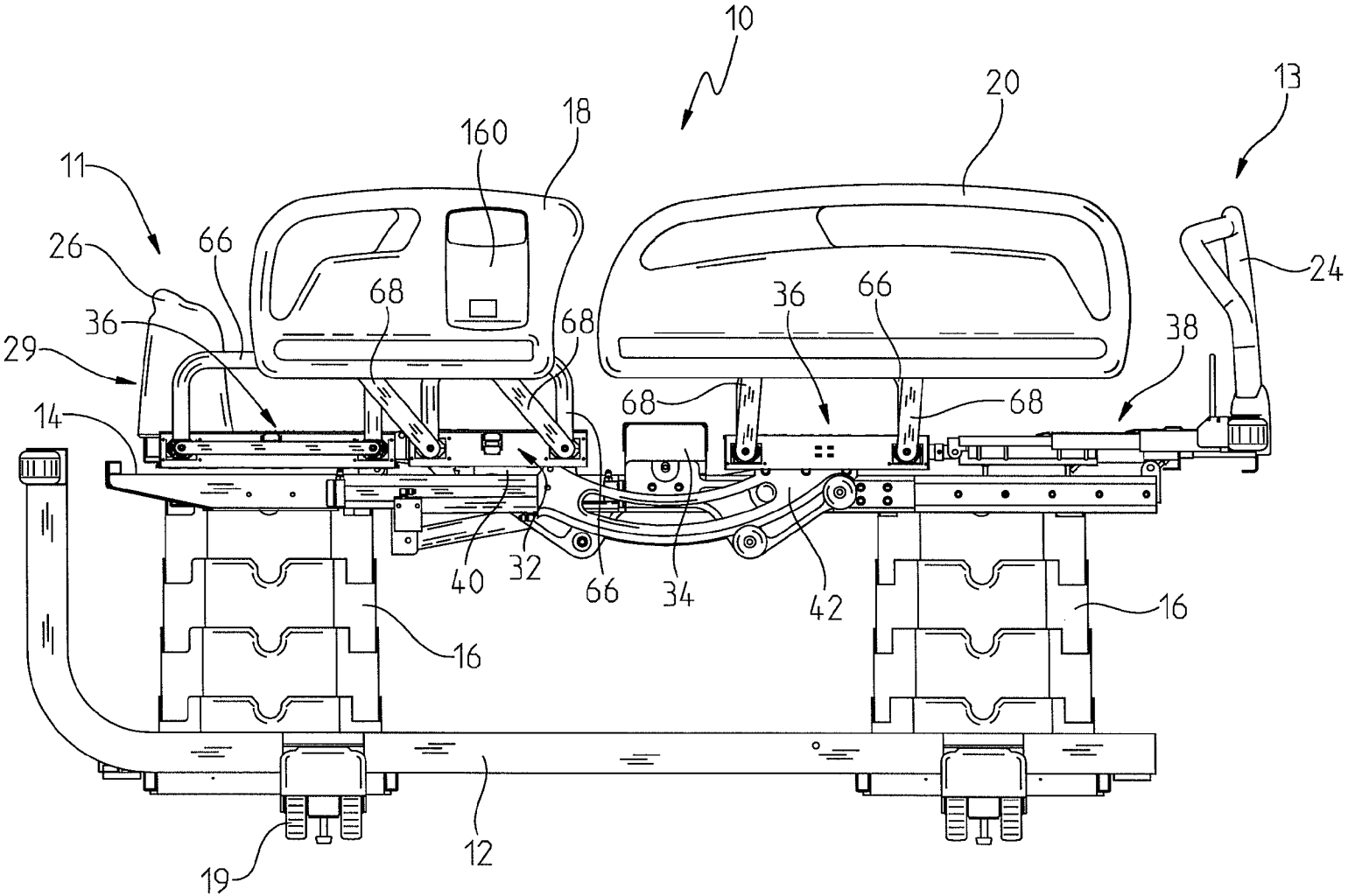
FIG. 1 is a side view of a patient support in the horizontal or flat position.
Figure 2:
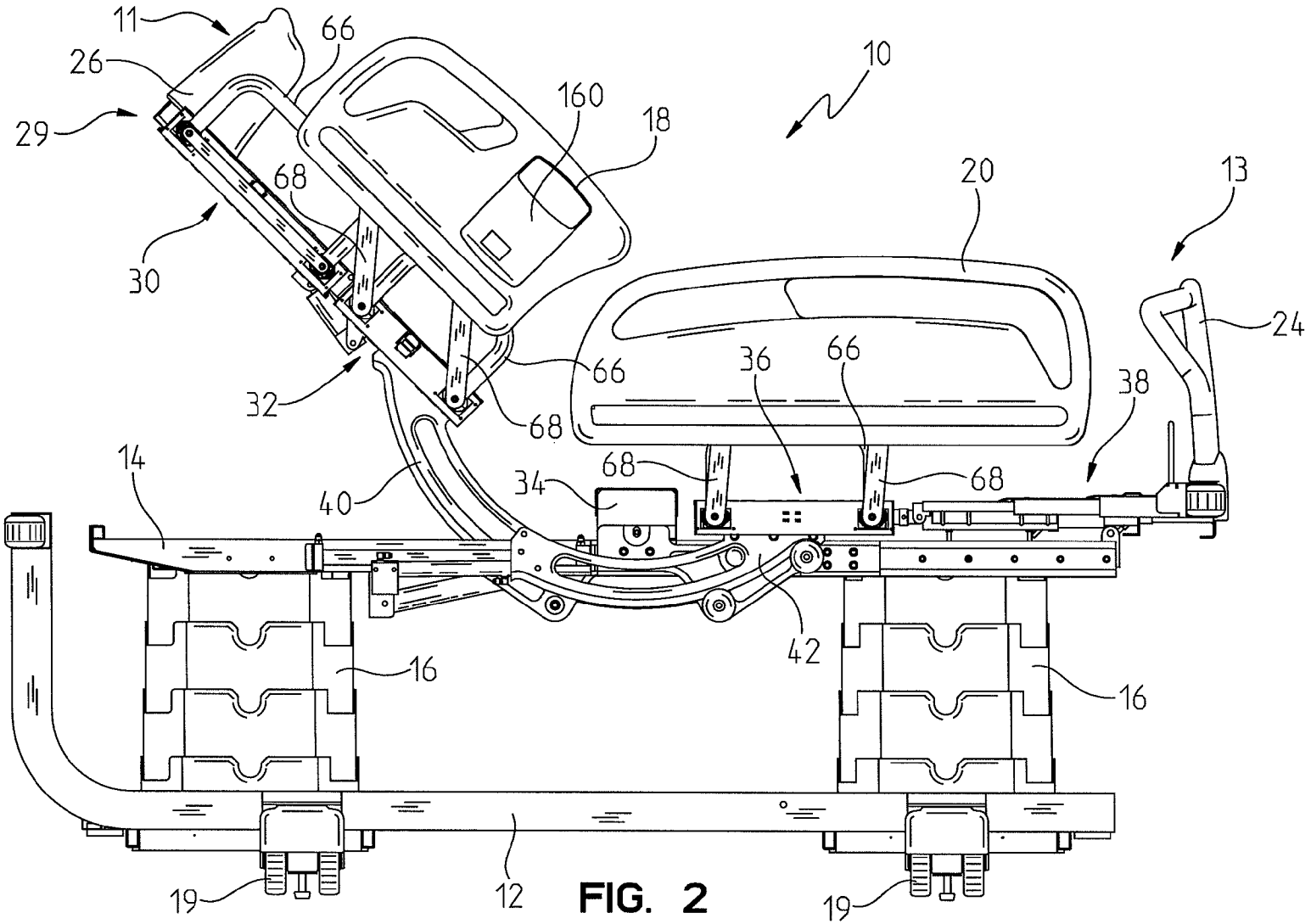
FIG. 2 is a side view of a patient support with the back and head sections elevated.

Referring to FIGS. 1 and 2, an exemplary embodiment of a patient support 10 having a head end 11 and a foot end 13 separated by a pair of longitudinal sides is shown. Patient support 10 includes a lower frame 12, an upper frame 14, a pair of columns 16, a pair of upper section siderails 18, a pair of lower section siderails 20, casters 19, a removable headboard 26, and a removable footboard 24. Columns 16 can be controlled to raise and lower patient support 10 relative to the ground. Patient support 10 also includes a deck 29 comprised of a plurality of sections which support a mattress. The deck 29 includes a head section 30, a back section 32, a seat section 34, a thigh section 36, and a foot section 38. In the illustrated embodiment, one or more sections of deck 29 can be articulated between a chair-shaped orientation and a substantially flat orientation. In another embodiment, patient support 10 includes at least one fixed substantially flat deck section. Patient support 10 can also be placed in the Trendelenburg and Reverse Trendelenburg positions by raising and/or lowering columns 16.

In the illustrated embodiment, back section 32 is coupled to a pair of inner arcuate members 40 which are supported by upper deck 14. Head section 30 is pivotally coupled to back section 32 by a hinge mechanism (not shown). Head section 30 can be moved relative to back section 32 and secured in position to provide optimum patient comfort. Seat section 34 is rigidly coupled to upper frame 14 and may include couplers (not shown) that couple to mattress 130, which is discussed below. Thigh section 36 is coupled to a pair of outer arcuate members 42 which are supported by upper frame 14. Thigh section 36 and foot section 38 are pivotally coupled together by a hinge mechanism (not shown). Inner arcuate members 40 and outer arcuate members 42 interact along with upper frame 14 to move the deck sections between various positions such as the chair position and the knee gatch position. The movement of inner and outer arcuate members 40 and 42 and the movement of patient support 10 in the chair position are explained in the related applications filed concurrently herewith, entitled "ADVANCED ARTICULATION SYSTEM AND MATTRESS SUPPORT FOR A BED" (U.S. application Ser. No. 11/192,698) and "BED HAVING A CHAIR EGRESS POSITION" (U.S. application Ser. No. 11/192,897), the disclosures of both are expressly incorporated by reference herein. In other embodiments, the articulation of deck 29 is actuated by a plurality of actuators such as linear actuators or hydraulic cylinders and a corresponding framework.

As shown in FIGS. 1 and 2, patient support 10 also includes upper and lower section siderails 18 and 20. Siderails 18 and 20 are moveable between raised and lowered positions. In the illustrated embodiment, siderails 18 and 20 are conventional "clocking" rails which rotate between the raised and lowered positions about a transverse axis of patient support 10. The distance between the siderails 18, 20 and the lateral edge of the adjacent deck sections does not change when the siderails are moved between the raised and lowered positions. Siderails 18 and 20 are coupled to back section 32 and thigh section 36, respectively, by links 68. It should be understood by one having ordinary skill in the art that siderails 18 and 20 could also be coupled to any of the deck sections such as head section 30. In another embodiment, siderails 18 and 20 rotate between the raised and lowered positions about a longitudinal axis of patient support 10. In this embodiment the distance between the siderails and the end of the deck section adjacent the mattress varies as the siderail is rotated.

Figure 3:
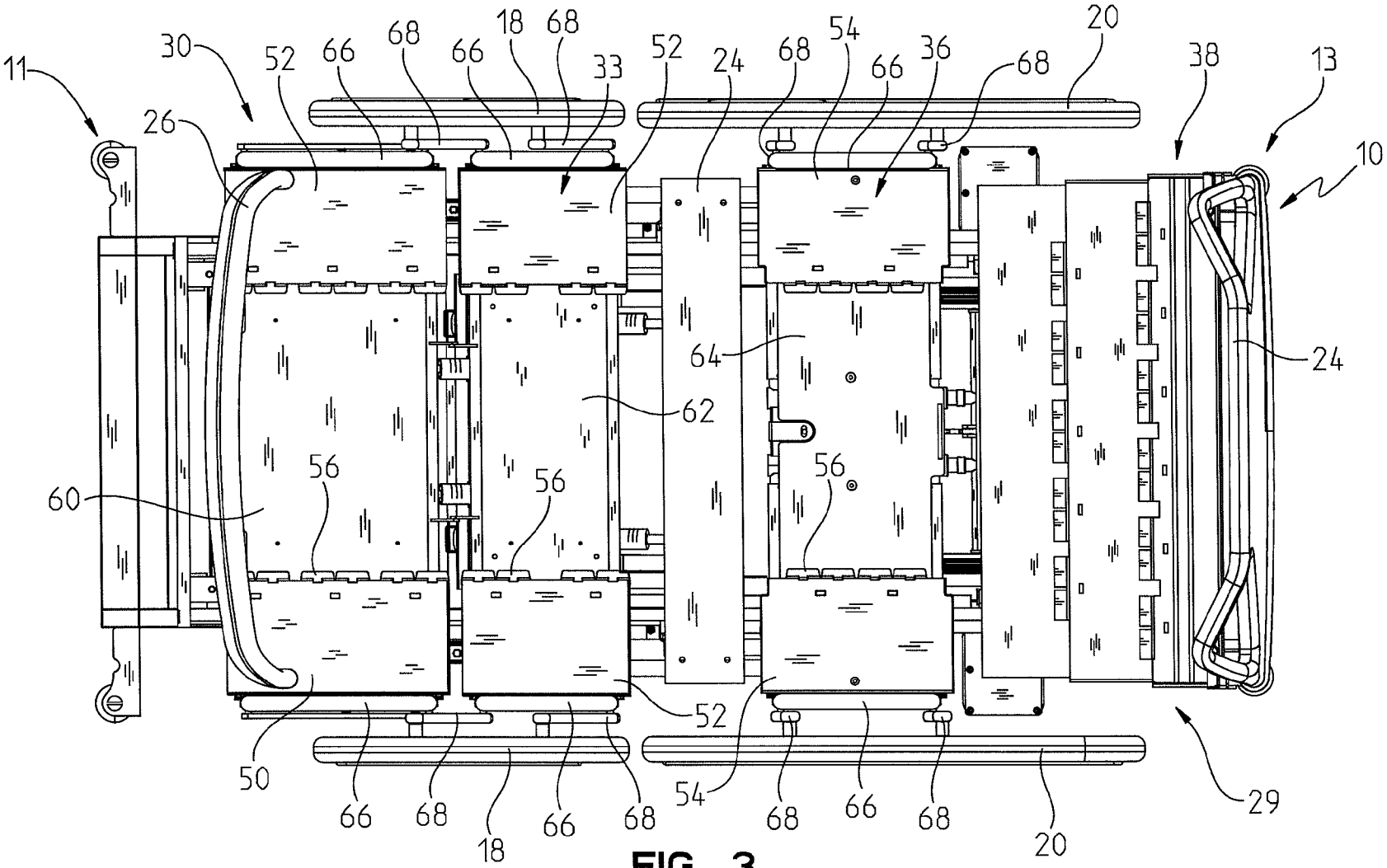
FIG. 3 is a top view of the patient support shown in FIGS. 1 and 2 with the deck in a narrower position.
Figure 4:
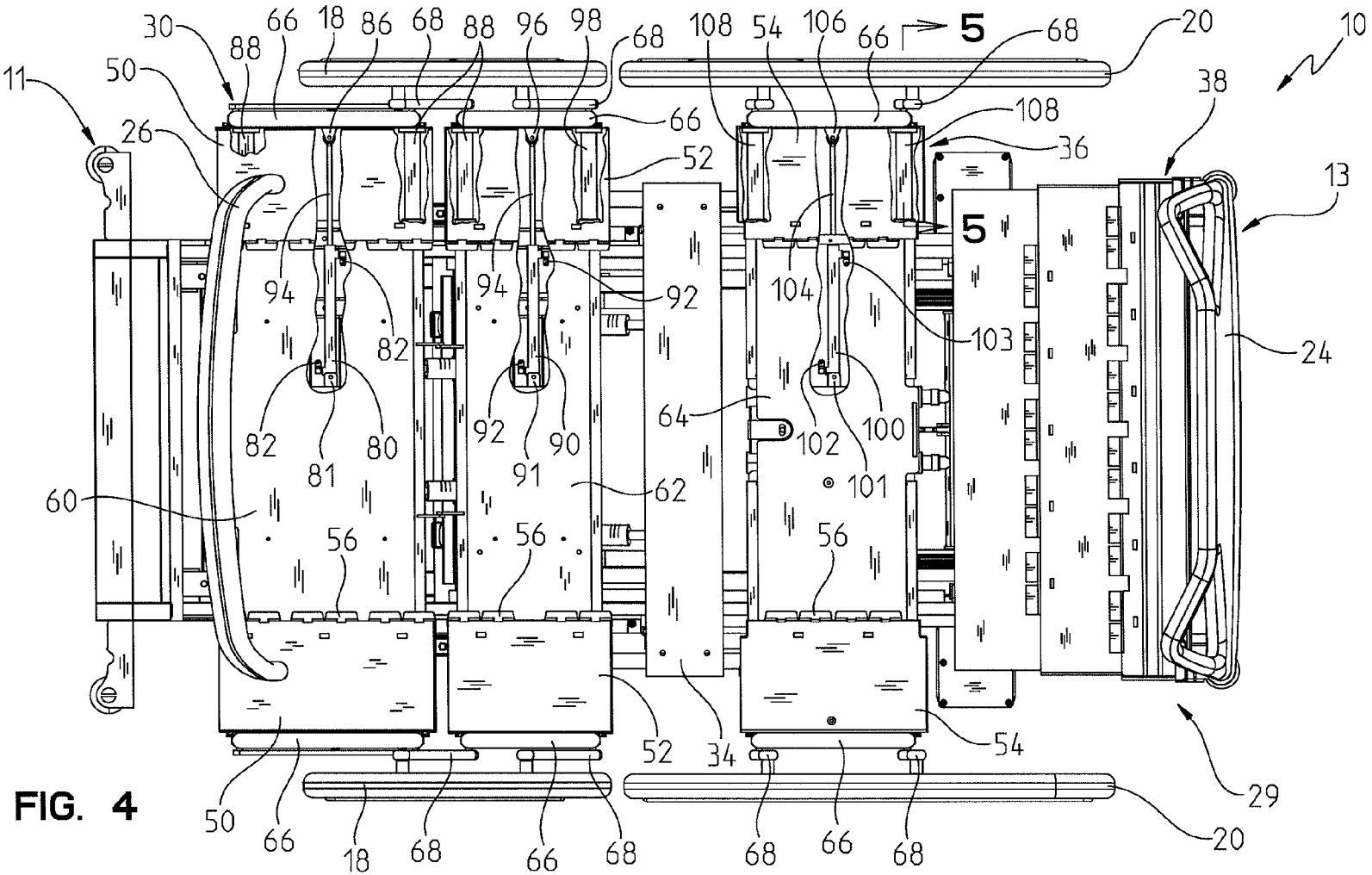
FIG. 4 is a top partial view of the patient support shown in FIG. 3 with the deck shown in an extended position.

As shown in FIGS. 3 and 4, head section 30, back section 32, and thigh section 36 each have expanding side panels 50, 52, and 54 which can expand from both longitudinal sides of center panels 60, 62, and 64 to widen patient support 10. As discussed above, bariatric patients are generally larger than average patients and may be more comfortable positioned on a wider than average patient support. Expandable deck sections allow caregivers to maneuver patient support 10 through doorways and hallways easily in the retracted or narrow position, as shown in FIG. 3, and provide optimum patient comfort by expanding the deck panels when a patient is positioned on patient support 10. Expanding side panels 50, 52, and 54 support mattress 130 (not shown) is described below.

Each longitudinal side of patient support 10 is substantially identical and includes expanding side panels 50, 52, and 54. Therefore, only one side of patient support 10 will be described. It should be understood that the construction and operation of expanding side panels 50, 52, and 54 on each side of center panels 60, 62, and 64 is substantially identical. Head section 30 includes a center panel 60 and expanding side panels 50. An expanding side panel 50 is coupled to each lateral side of center panel 60.

Each expanding panel 50, 52, 54 has a linear slide incorporated therein. The linear slides work independently of each other in the illustrated embodiment. The linear slides are activated by either a hydraulic cylinder or a linear actuator as described below.

Curved tabs 56 are coupled to or formed on the inner edges of side panels 50 to slide over center panel 60 to prevent damaging a mattress positioned on patient support 10 when side panels 50 extend and retract.

As shown in FIG. 4, actuator 80 is coupled between side panel 50 and the bottom side of center panel 60. In the illustrated embodiment, actuator 80 is a conventional two way hydraulic cylinder including input and output ports 82 and shaft or rod 84. In other embodiments, actuator 80 is a one way hydraulic cylinder, a linear actuator, or any other suitable moving mechanism. Actuator 80 is coupled to center panel 60 by bracket 81 and to side panel 50 by bracket 86. Actuator 80 is actuated by a controller, which is described below, to extend or retract side panel 50 therefore widening or narrowing deck 29 of patient support 10. Actuators 80 on each side of center panel 60 are controlled by the controller 168 and move simultaneously.

Support tubes 88 are also coupled between side panel 50 and center panel 60. In the illustrated embodiment, support tubes 88 are positioned on each longitudinal end of side panel 50. It should be understood by one having ordinary skill in the art that support tubes 88 could be positioned at any position along side panel 50 and more or less than two support tubes could be used.

Back section 32 and thigh section 38 includes include center panels 62 and 64 and expanding side panels 52 and 54 which are substantially similar to center panel 60 and expanding side panels 50 on head section 30. Side panels 52 are coupled to center panel 62 by actuators 90 and support tubes 98. Each actuator 90 includes input and output ports 92 and rod 94 and is coupled to center panel 62 by bracket 91 and side panel 52 by bracket 96. Side panels 54 are coupled to center panel 64 by actuators 100 and support tubes 108. Each actuator 100 includes input and output ports 102 and rod 104 and is coupled to center panel 64 by bracket 101 and side panel 64 by bracket 106. Actuators 90 and 100 are also controlled by controller 168, which is described below, and move simultaneously along with actuators 80 to widen or narrow deck sections 30, 32, and 36. In other embodiments, patient support 10 may include more or less than five deck sections. In an alternative embodiment, other deck sections or combinations of deck sections may include expanding side panels such as the seat section and the foot section.

Figure 5:
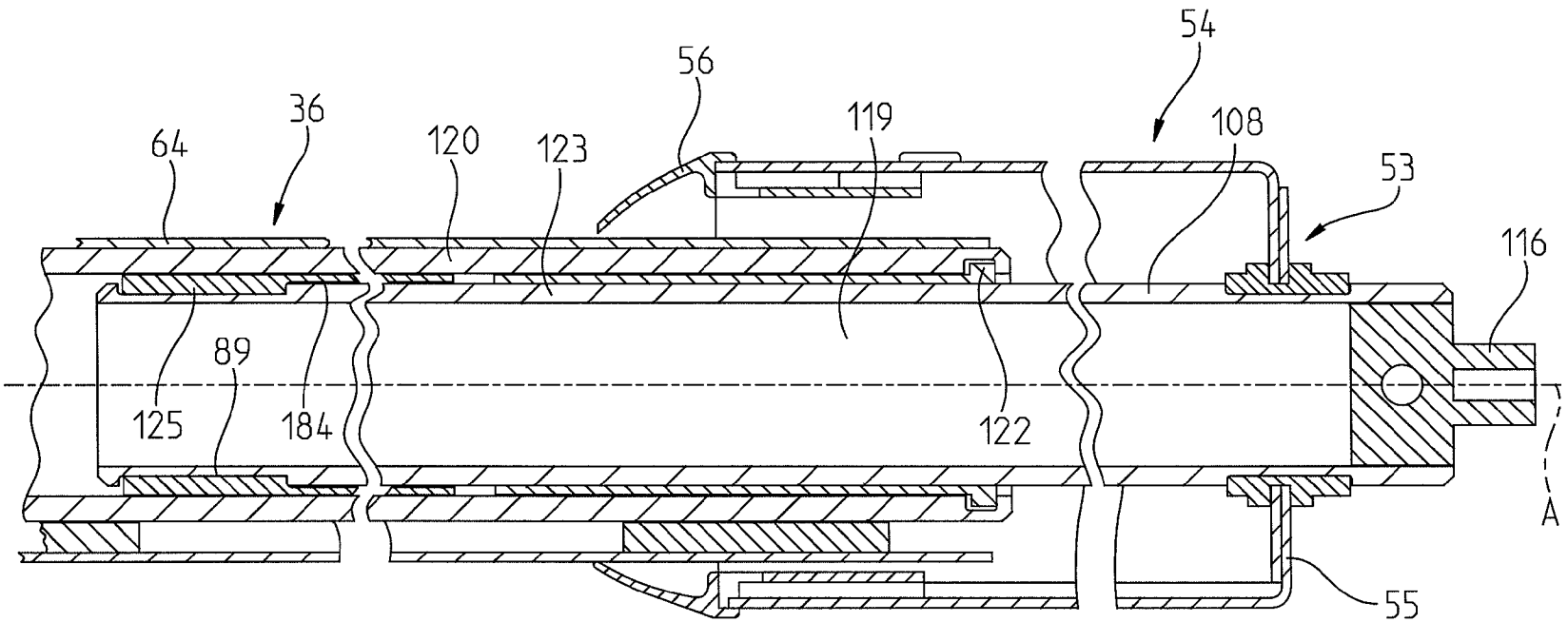
FIG. 5 is a cross-sectional view taken along lines 5-5 of a deck section of the patient support shown in FIG. 4.
Figure 6:
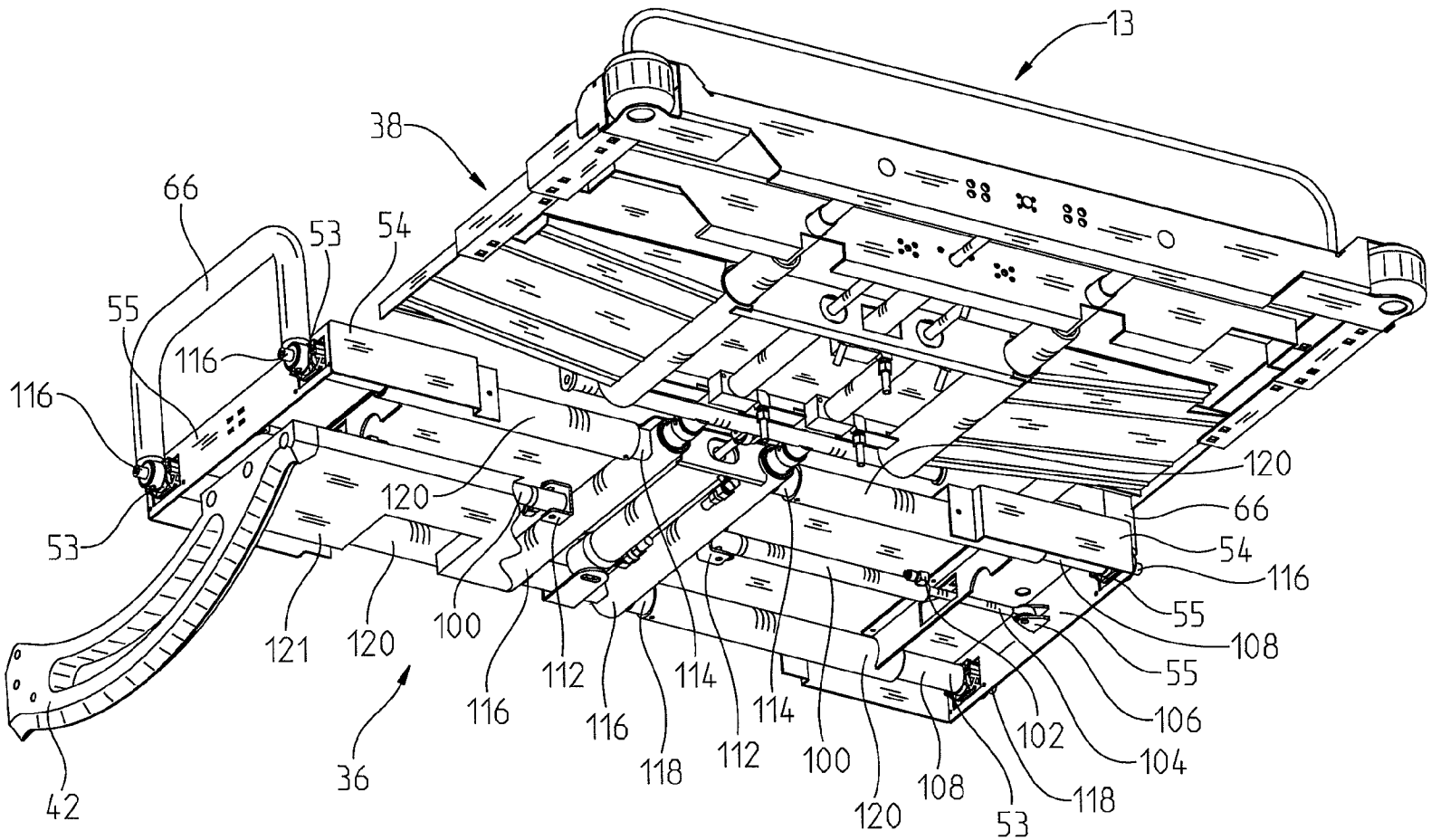
FIG. 6 is a bottom partial view of the thigh and foot sections of the patient support shown in FIGS. 3 and 4.

Referring now to FIG. 5, a cross-section taken through lines 5-5 of FIG. 4 further illustrating panels 54, 64 and support tube 108 in an extended position. It should be understood that the structure of panels 50 and 60 and support tubes 88, and panels 52 and 62 and support tubes 98 is substantially the same as panels 54 and 64 and support tubes 108. Support tubes 108 extend through openings 53 in vertical surfaces 55 of panel 54. End 116 is fixed in place on the outer end of support tubes 108. In the illustrated embodiment, mattress retention brackets 68 and siderails 20 are mounted on ends 116 of support tubes 108. Support tubes 108 extend and retract telescopically from tubes 120 which are below center panel 60, as shown in FIG. 6. Bushings 123 and 124 are positioned around each support tube 88 and within tubes 120 to reduce friction and maintain alignment of tubes 88 and 120 along axis A as tubes 108 extend and retract from tubes 120. Bushings 123 and 124 may be constructed of a metal such as, for example, steel or brass or any other suitable material to reduce wear such as, for example, nylon. Each bushing 123 includes an expanded portion 122 which fits into a groove 119 of tube 120 to secure bushing 123 in place. Each bushing 124 also includes an expanded portion 125 sized to correspond to a groove 89 in support tube 108. Bushing 123 remains stationary when support tube 88 is extended or retracted from tube 120. Bushing 124 slides along with support tube 88 during extension and retraction to maintain alignment and prevent binding. In other embodiments, support tubes 108 contain multiple telescoping sections.

Referring now to FIG. 6, a bottom view of thigh section 36 and foot section 38 is shown. In the illustrated embodiment, foot section 38 is extendable, but in other embodiments patient support 10 may also include a fixed length foot section. Tubes 120 are coupled to guide tubes 116 by brackets 114. Actuators 100 are coupled to guide tubes 116 by brackets 112 on one end and coupled to vertical surfaces 55 of side panels 54 by bracket 106 on the opposing end. Mattress retention brackets 66 are coupled to ends 116. For clarity, siderails 20, which are also coupled to ends 116, are not shown in FIG. 6. Mattress retention brackets 66 are constructed of a rigid material such as plastic or metal and are used to compress the mattress when side panels 54 are retracted and provide support for a patient entering or exiting patient support 10. Cover 121, shown in partial in FIG. 6, is present on both lateral sides of patient support 10 to cover are actuators 100 and one of the tubes 120. Covers 121 are coupled to outer arcuate members 42 which raise and lower thigh section 36.

Figure 7:
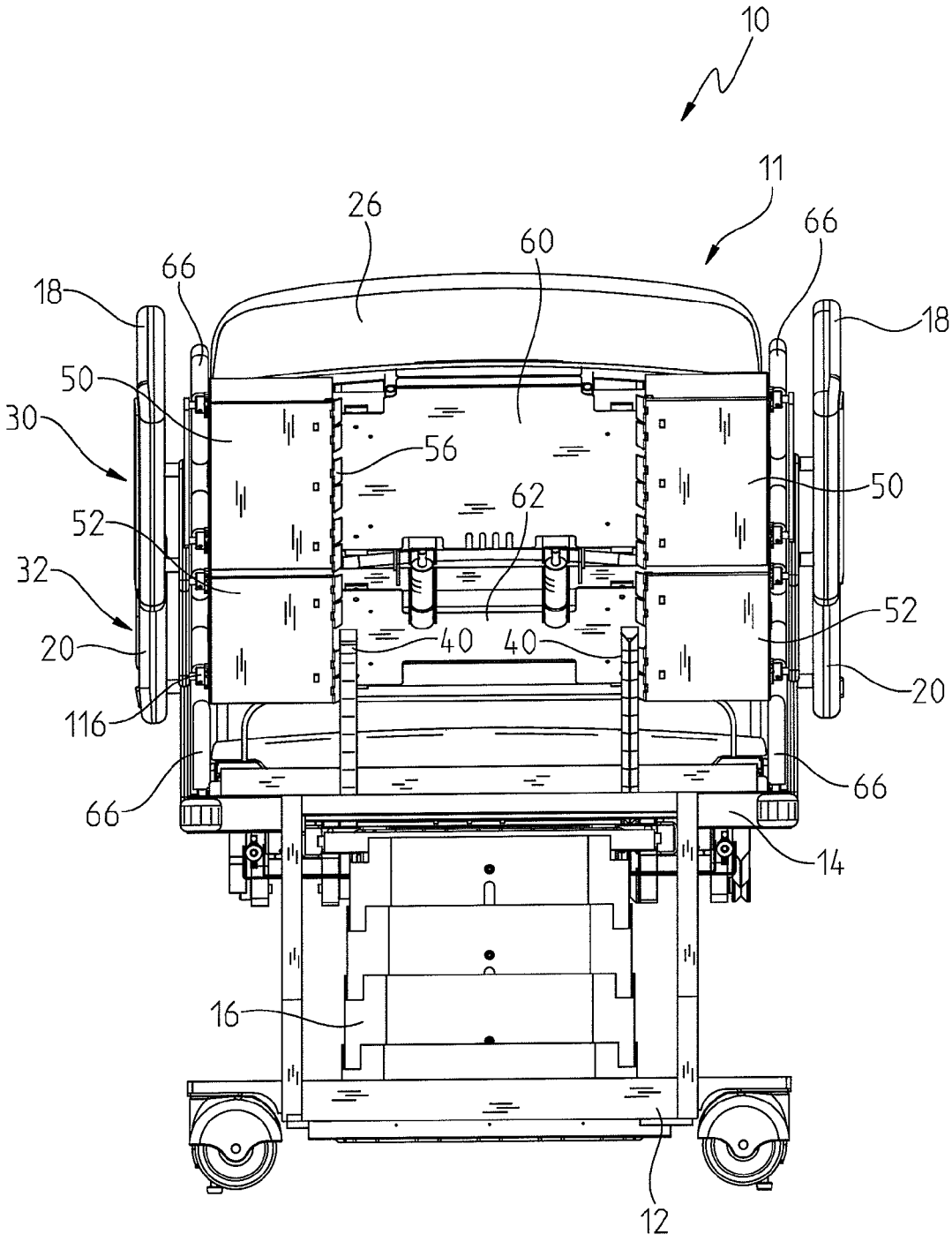
FIG. 7 is a rear view of the backside of the head and back sections of the patient support shown in FIGS. 3 and 4 when the back and head sections are elevated.

Referring now to FIG. 7, a view taken from the head end along the longitudinal axis of patient support 10 with head section 30 and back section 32 in the inclined position is shown. Side panels 50 and 52 each include a top plate, a bottom plate, and a vertical surface connecting the top and bottom plates. The bottom plates of side panels 50 and 52 are shown in FIG. 7. Curved tabs 56 are present on the inner edges of the bottom plates of side panels 50 and 52.

As best shown if FIGS. 1-3, patient support 10 also included a plurality of mattress retention brackets 66 positioned on head section 30, back section 32, and thigh section 36. Mattress retention brackets 66 are coupled to ends 116 of support tubes 88, 98, and 108 and are positioned adjacent the outer lateral edge of expanding side panels 50, 52, and 54 so that mattress retention brackets 66 are extended or retracted as the side panels 50, 52, and 54 are extended or retracted. In the illustrated embodiment, mattress retention brackets 66 have an inverted U-shape to compress the sides of mattress 130 when deck sections 50, 52, and 54 of patient support 10 are retracted. In other embodiments, mattress retention brackets 66 are solid vertical plates or any other suitable shape. Mattress retention brackets 66 may also provide a stable support or a handhold for aiding a patient attempting to enter or exit patient support 10. Mattress retention brackets 66 may be constructed out of rigid substance such as metal or plastic and may include an outer foam cover to provide a cushioning effect.

Figure 8:
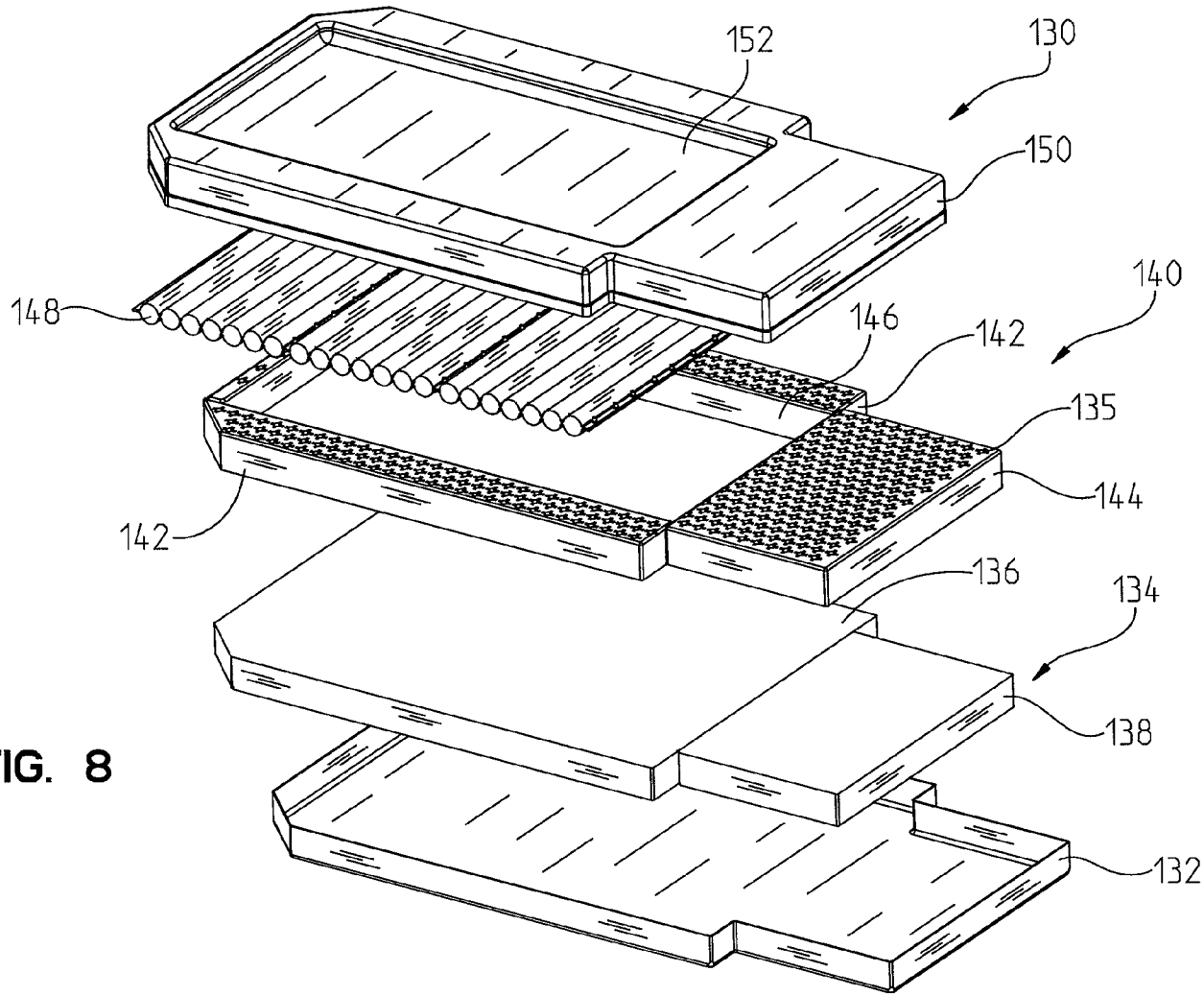
FIG. 8 is an exploded view of one embodiment of a mattress configured to be positioned on a patient support.
Figure 9A:
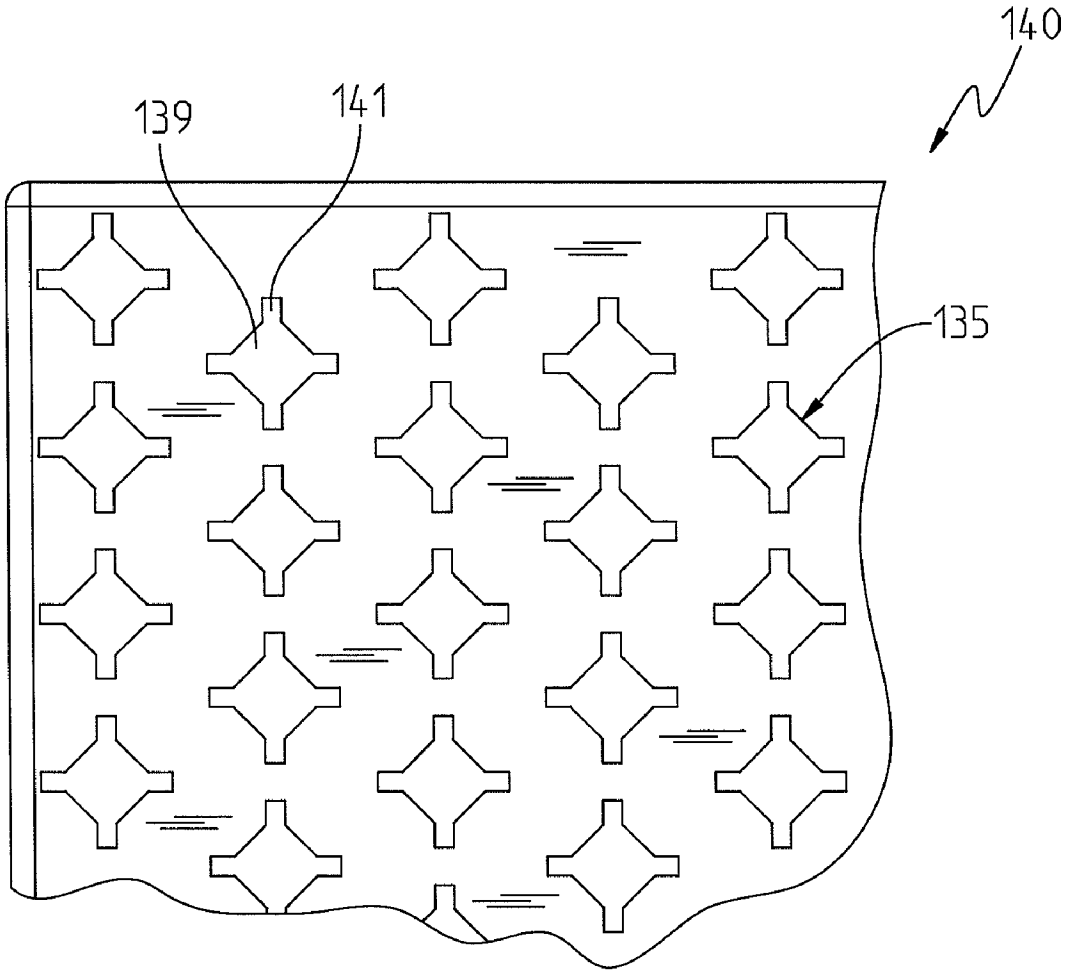
FIG. 9A is a simplified top view of the vertical openings formed in sections of the mattress shown in FIG. 8.
Figure 9B:
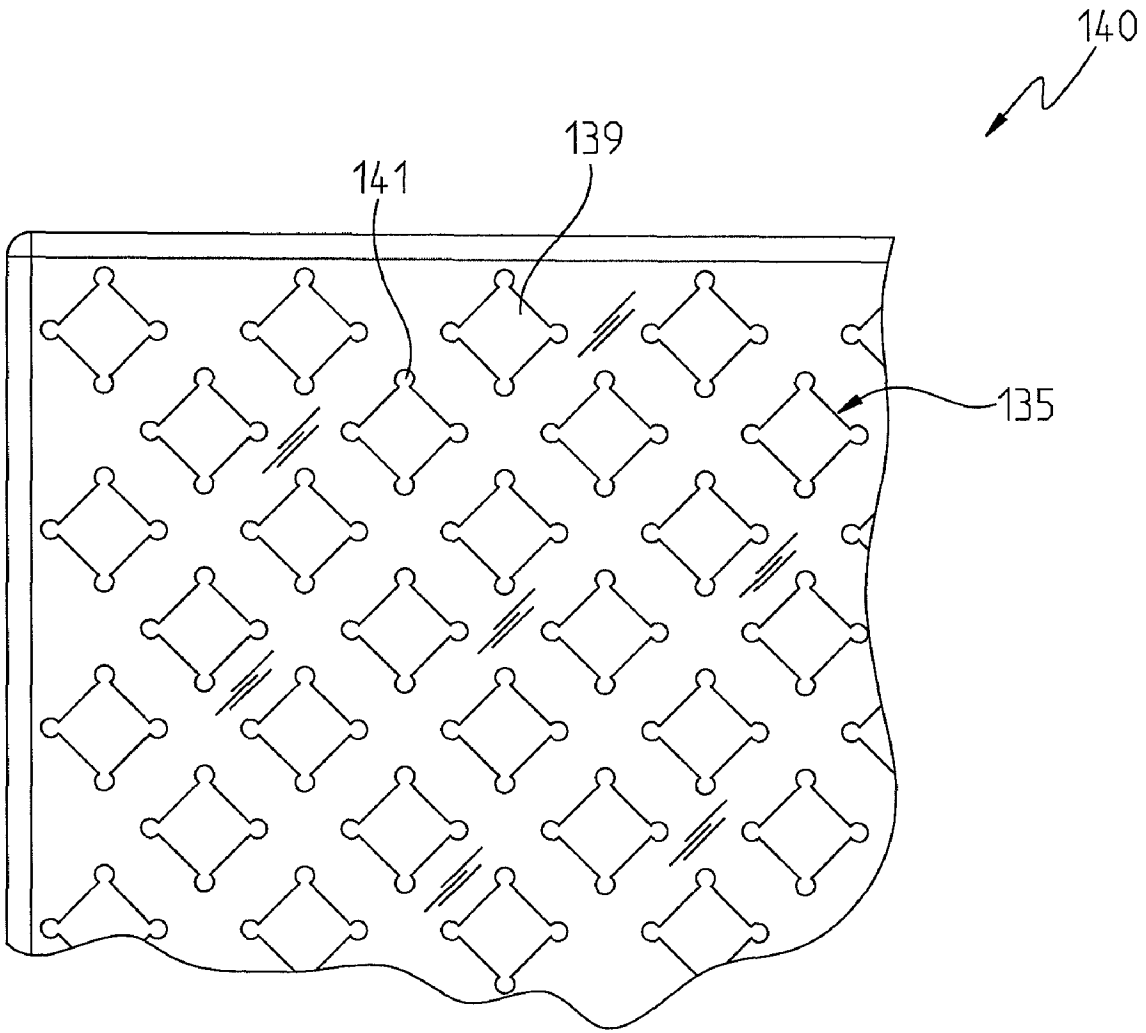
FIG. 9B shows a top view of another configuration of vertical openings formed in the mattress of FIG. 8.

One embodiment of a mattress for patient support 10 is shown in FIG. 8. Mattress 130 includes a bottom cover 132, a lower layer 134, an upper layer 140, a plurality of inflatable bladders 148, and a top cover 150. Covers 132 and 150 couple together and enclose lower layer 134, upper layer 140, and the plurality of inflatable bladders 148. Covers 132 and 150 may be coupled together by any suitable means such as a zipper or VELCRO. Lower layer 134 and upper layer 140 are illustratively formed from a semi-rigid material such as foam. In other embodiments, mattress 130 may include only foam sections or only inflatable bladders or any other material suitable for supporting a patient. In the illustrated embodiment, layer 140 is formed with vertical openings or cut-out portions 135 as shown in FIGS. 9A and 9B. In other embodiments, layer 134 may also include one or more vertical openings 135. Vertical openings 135 allow mattress 130 to be compressed both longitudinally and horizontally without creating a substantial raised area which could cause patient discomfort. For example, mattress retention brackets 66 horizontally compress mattress 130 with deck section 30, 32, and 36 are moved to the retracted position narrowing deck 29.

As shown in FIG. 9A, vertical openings 135 have a substantially diamond-shaped profile including four side portions 139 having notched portions 141 at the comers to permit the mattress 134 to expand and retract in both longitudinal and lateral directions. In the embodiment of FIG. 9A, vertical openings 135 are spaced apart in a staggered fashion, with alternating rows being staggered so that, for example, the position of the openings in the second row is offset from the openings in the first row, as shown. In other embodiments, vertical openings 135 and/on notched portions 141 may have a square profile, a circular profile, an octagonal profile, a star-shaped profile or any other suitable profile. For example, FIG. 9B shows vertical openings 135 having circular notched portions 141 intended to reduce the likelihood of tearing at the comers as the openings 135 collapse during compression. Also, in the embodiment of FIG. 9B, the openings 135 are substantially evenly spaced apart.

In the illustrated embodiment of patient support 10, foot section 38 is extendable and retractable. Vertical openings 135 in portions 138 and 144 allow mattress 130 to vertically expand and retract as foot section 38 is moved. Lower layer 134 includes first portion 136 and second portion 135. Upper layer 140 includes first portion 142 and second portion 144. In the illustrated embodiment, first portions 136 and 142 are wider than second portions 138 and 144, respectively, and are designed to be positioned on head section 30, back section 32, seat section 34, and thigh section 36. Second portions 138 and 144 are designed to be supported by foot section 38. Second portions 138 and 144 are narrower than first portions 136 and 142 because the patient's torso and seat section are generally wider than the patient's legs. In alternative embodiments, mattress 130 is rectangularly shaped and has the same width through its entire length.

In the illustrated embodiment, first portion 142 of second layer 140 includes a recess 146 which receives the plurality of inflatable bladders 148. Inflatable bladders 148 are controlled by a controller (not shown) that allows the caregiver or patient to adjust the pressure of the inflatable bladders for optimum patient comfort. In an alternative embodiment, second layer 140 is similar to first layer 134 and does not include a recess. Top cover 150 also includes a recess 152 to allow the central portion of the patient's body to contact the plurality of inflatable bladders 148.

Figure 10:
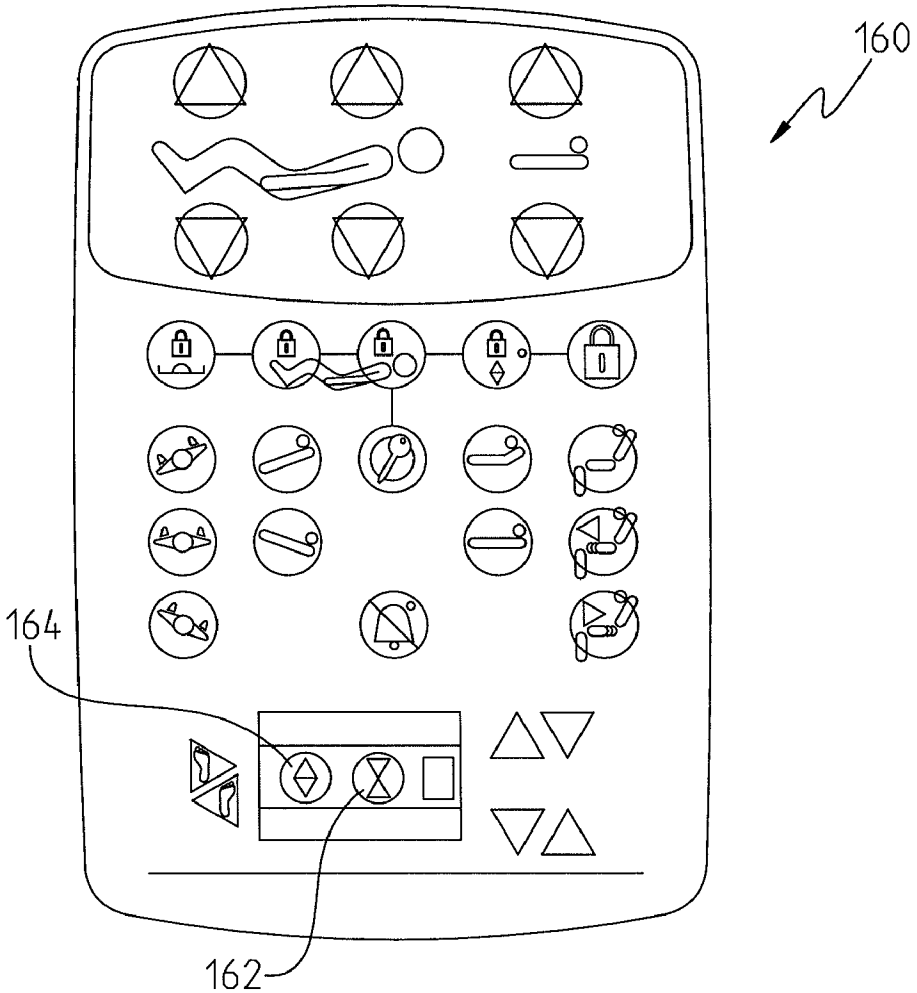
FIG. 10 is a side view of one embodiment of an input device for the patient support shown in FIGS. 3 and 4.

An input device 160 of patient support 10 is shown in FIG. 10. Input device 160 includes a plurality of buttons configured to control various functions of patient support 10 such as hi-low and deck articulation. Specifically, input device 160 includes buttons 162 and 164 which can be used to widen and narrow the deck sections 30, 32, and 36 of patient support 10. In the illustrated embodiment, input device 160 is positioned in siderail 18. In other embodiments, input device 160 may be located on a pendant or any other suitable position which can be accessed by a caregiver.

Figure 11:
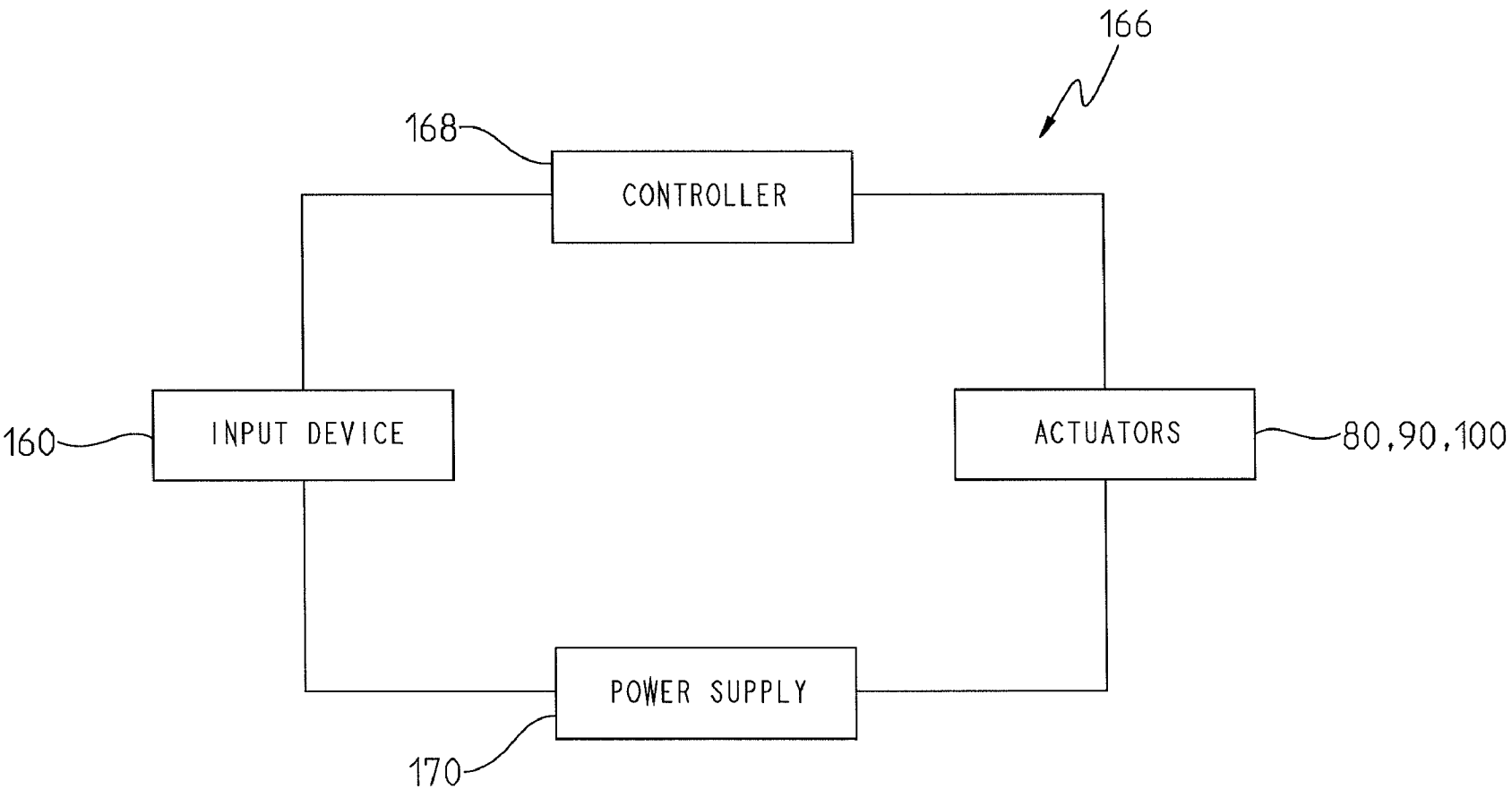
FIG. 11 is a schematic for a control system for the patient support shown in FIGS. 3 and 4.

As shown in FIG. 11, depressing button 162 on input device 160 actuates the controller 168 to power actuators 80, 90, 100 with power from power supply 170 to widen the deck sections 30, 32, and 36 by simultaneously extending expanding side panels 50, 52, and 54. Conversely, depressing button 164 on input device 160 actuates controller 168 to power actuators 80, 90, and 100 with power from power supply 170 to simultaneously retract side panels 50, 52, and 54 to narrow the deck of patient support 10. Buttons 162 and 164 are configured to transmit a control signal only when depressed. Actuators 80, 90, and 100 only extend or retract when either of the buttons are being depressed by a patient or caregiver. For example, if a caregiver chooses to widen deck sections 30, 32, and 36 only slightly, the caregiver may depress button 162 and release it before actuators 80, 90, and 100 are fully extended. Actuators 80, 90, and 100 can only by moved by depressing either button 162 or 164 and are in effect locked in place when control button is not being depressed. In an alternative embodiment, buttons 162 and 164 are "one-touch" buttons which either fully extend or fully retract actuators 80, 90, and 100 with a single touch of the button. In another alternative embodiment, actuators 80, 90, and 100 have separate control buttons and are individually controlled.

As discussed above, siderails 18 and 20, which are coupled to ends 1 16 of support tubes 98 and 108 of back section 32 and thigh section 36, extend and retract as side panels 52 and 54 are extended and retracted. Siderails 18 and 20 are also locked or secured in position except when side panels 52 and 54 are being extended or retracted.

Figure 12:
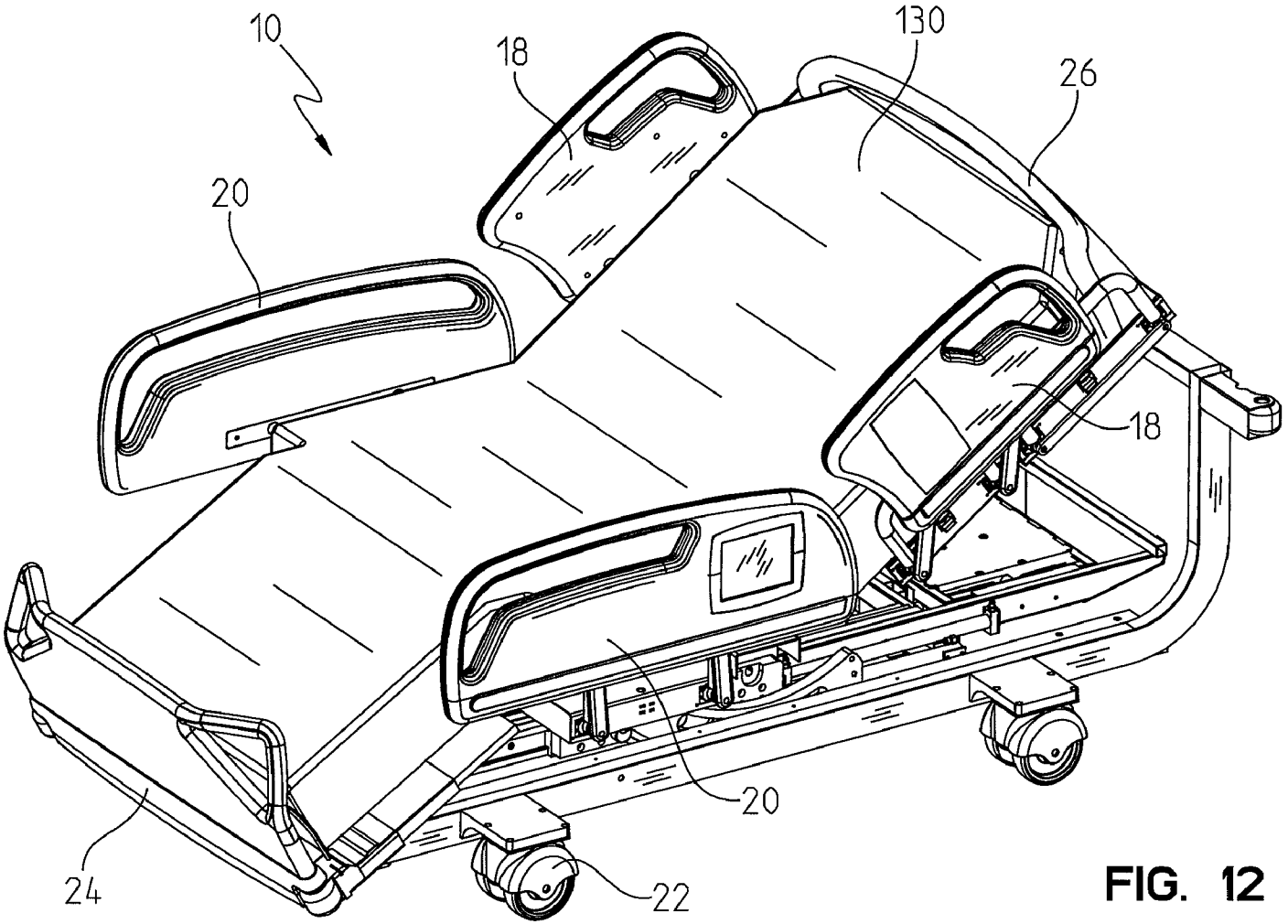
FIG. 12 is a perspective view of an exemplary bed frame with mattress positioned thereon, in accordance with the present invention.

FIG. 12 shows a perspective view of an exemplary patient support 10 including a mattress 130 positioned thereon, in accordance with the present invention. Coupled to the patient support 10 are a headboard 26, a footboard 24, a pair of opposing head section siderails 18, and a pair of opposing thigh section siderails 20. The patient support 10 is movably supported by dual-wheel casters 22. The powered expandable width feature is incorporated into either or both of head section siderails 18 and thigh section siderails 20. Controls for controlling expansion and retraction of the expanding side panels are positioned on or in one or more of the siderails 18, 20.

Figure 13:
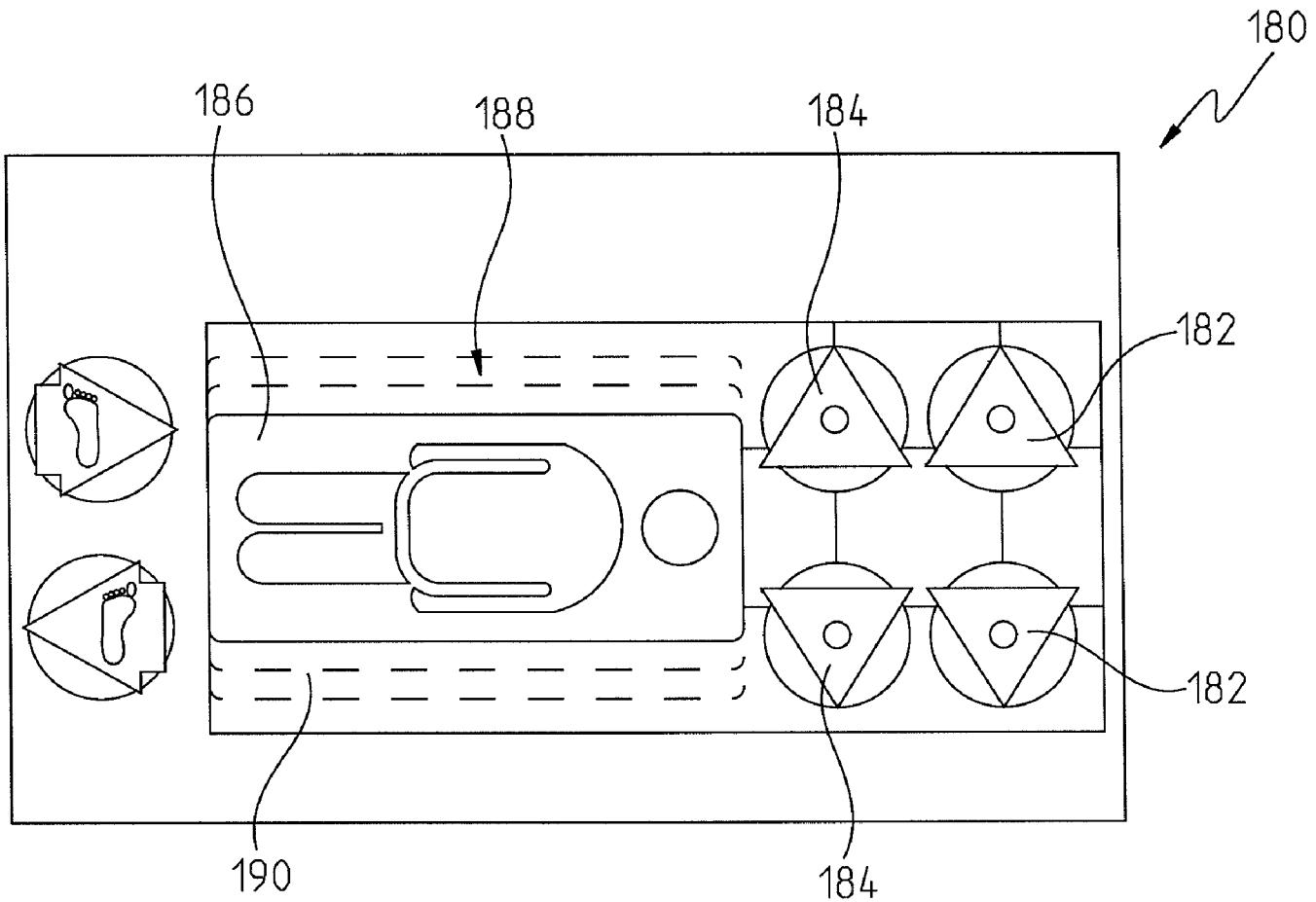
FIG. 13 is a schematic of a graphical control apparatus for controlling the expandable width of the mattress in accordance with the present invention.
Figure 14:
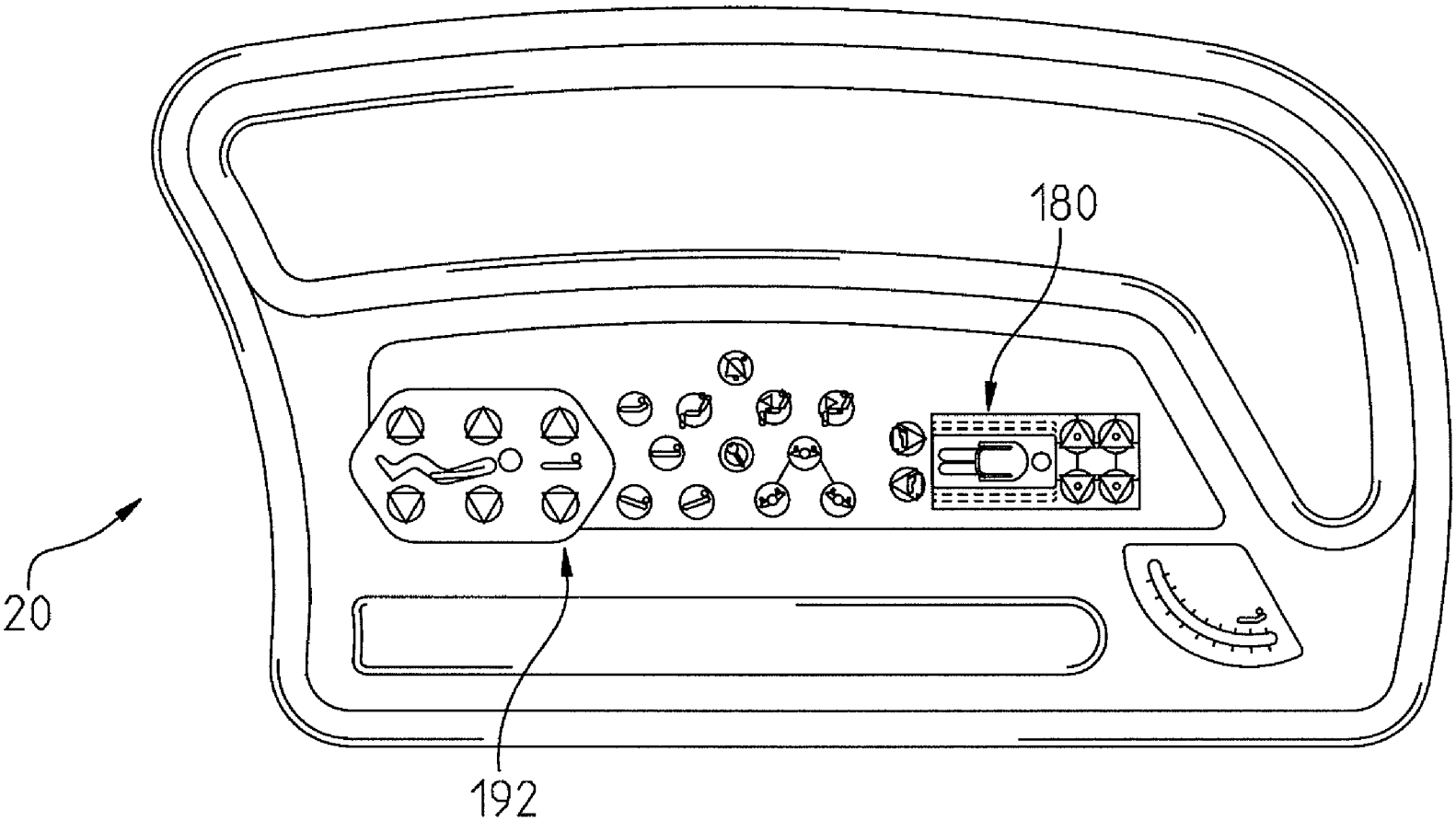
FIG. 14 is a schematic of a control apparatus such as shown in FIG. 13 being positioned on a siderail.

An exemplary set of controls 180 for operating the expandable width feature discussed above is shown in FIG. 13. These controls 180 may be incorporated into or coupled to an input device 160, one or more siderails 18, 20 or other areas of patient support 10, for example as shown in FIG. 14. Activating the controls 180 powers one or more of the activators 80, 90, 100 as described above.

The controls 180 as illustrated include separate "in" 182 and "out" 184 controls 182, 184 for each side 188, 190 of the patient support 10. Activating one of the "out" arrows 184, e.g., by touch, results in the expandable portion of the corresponding side panel being extended outwardly away from the center of the patient support 10 in order to increase the width of that section of the bed. Similarly, activating one of the "in" arrows 184 results in the expandable portion being retracted inwardly toward the center of the patient support 10 to decrease the width of that section of the bed. In the illustrated embodiment, activating either the "in" or "out" button for a particular side 188, 190 of the bed results in all of the expandable deck sections (e.g., head, back, and thigh) being adjusted on that side 188 or 190, respectively. Areas 188, 190 in FIG. 3 graphically illustrate expandable-width portions of a patient support.

FIG. 14 shows controls 180 coupled to or mounted in a siderail 20. Such controls may alternatively or in addition be coupled to or mounted in one or more of siderails 18. Other bed function controls 192 may also be coupled to or mounted in the siderails 18, 20.

Although specific illustrated embodiments of the invention have been disclosed, it is understood by those skilled in the art that changes in form and details may be made without departing from the spirit and scope of the invention. The present invention is not limited to the specific details disclosed herein, but is to be defined by the appended claims.

The invention claimed is:

1. A patient support comprising:

a frame;

a deck supported by the frame, the deck being configured to support a patient, the deck including a first portion and a second portion that is extendable laterally relative to the first portion to widen the deck;

an actuator operable to move the second portion in a direction generally parallel to a top surface of the deck between an extended position and a retracted position, and a user interface having controls that are used to provide signals to command operation of the actuator.

2. The patient support of claim 1, wherein the controls comprise an out button that is usable to command operation of the actuator to move the second portion to the extended position and an in button that is usable to command operation of the actuator to move the second portion to the retracted position.

3. The patient support of claim 2, wherein the in and out buttons have arrow indicia ranged to point in opposite directions.

4. The patient support of claim 1, further comprising a siderail coupled to the frame and the user interface is coupled to the siderail.

5. The patient support of claim 1, further comprising a controller, the user interface being coupled to the controller and the controller being configured to receive the signals from the user inputs interface as input signals, process the input signals, and provide output signals that operate the actuator.

6. The patient support of claim 1, further comprising a foot section having a foot portion that is extendable to lengthen the foot section, the controls of the user interface being usable to extend and retract the foot portion.

7. The patient support of claim 1, wherein the controls are one touch controls such that a momentary press of one of the controls results in the actuator operating for a sufficient amount of time to fully extend the second portion relative to the first portion and such that a momentary press of another of the controls results in the actuator operating for a sufficient amount of time to fully retract the second portion relative to the first portion.

8. A patient support comprising:

a frame;

a deck supported by the frame, the deck being configurable to support a patient, the deck including a plurality of deck sections including an extendable foot section, at least one of the deck sections including first and second portions, the second portion moveable in a direction generally parallel to a top surface of the deck between one of a laterally extended position and a laterally retracted position relative to the first portion; and a user interface having controls that are usable to change the length of the foot section and to change the width of the deck by moving the second portion relative to the first portion.

9. The patient support of claim 8, wherein the at least one deck section including the first and second portions comprises at least one of a head section, a back section, a seat section, and a thigh section.

10. The patient support of claim 9, wherein the head section, the back section, and the thigh section each include first and second portions, the second portion moveable between a laterally extended position and a laterally retracted position.

11. The patient support of claim 8, further comprising a mattress including a plurality of vertical openings configured to allow the mattress to compress when the extendable foot section is moved between an extended position and a retracted position.

12. A patient support comprising:

a frame;

a deck supported by the frame, the deck including a first portion and a second portion configured to extend and retract laterally relative to the first portion to widen and narrow the deck;

a mattress supported by the deck;

a mattress support member positioned adjacent the mattress and configured to laterally compress the mattress when the second portion is retracted relative to the first portion; and a user interface having controls that are usable to signal movement of the second portion relative to the first portion to widen and narrow the deck.

13. The patient support of claim 12, wherein the mattress support member is supported by the second portion.

14. The patient support of claim 12, wherein the mattress support member comprises a bracket having an inverted U-shape.

15. The patient support of claim 12, wherein the mattress support member comprises a vertical plate.

16. The patient support of claim 12, further comprising a siderail, the mattress support member being situated between the siderail and the mattress.

17. The patient support of claim 16, wherein the siderail is coupled to the second portion to laterally extend and retract therewith.

18. The patient support of claim 17, wherein the siderail is movable between a raised position and a lowered position when the second portion is extended or retracted.

19. The patient support of claim 16, wherein the user interface is coupled to the siderail.

20. The patient support of claim 12, further comprising a foot section having a foot portion that is extendable to lengthen the foot section, the controls of the user interface being usable to extend and retract the foot portion.

* * * * *